US007497724B1

(12) United States Patent
Fong et al.

(10) Patent No.: US 7,497,724 B1
(45) Date of Patent: Mar. 3, 2009

(54) CABLE CONNECTOR ASSEMBLY WITH IMPROVED WIRE ORGANIZER

(75) Inventors: Jen-Guo Fong, Tu-Cheng (TW); Eric (YunChien) Lin, Fullerton, CA (US); Pei Tsao, Fullerton, CA (US); Joseph Tang, Fullerton, CA (US); An-Jen Yang, Fullerton, CA (US); Tien-Lu Kao, Fullerton, CA (US); Yin-Tse Kao, Fullerton, CA (US); Lisa Chou, Fullerton, CA (US); Jim Zhao, Fullerton, CA (US); Wei Yao, Kun-Shan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/906,873

(22) Filed: Oct. 4, 2007

(51) Int. Cl.
*H01R 12/24* (2006.01)

(52) U.S. Cl. ..... 439/497; 439/936

(58) Field of Classification Search ..... 439/493, 439/497, 579, 936
See application file for complete search history.

(56) References Cited

U.S. PATENT DOCUMENTS 5,281,762 A * 1/1994 Long et al. ..... 174/78
6,380,485 B1 * 4/2002 Beaman et al. ..... 174/88 R
6,489,563 B1 * 12/2002 Zhao et al. ..... 174/88 C
6,685,501 B1 2/2004 Wu et al.
6,726,503 B2 4/2004 Waddell et al.
6,739,904 B2 5/2004 Wu
6,764,342 B2 7/2004 Murayama et al.
6,869,308 B2 3/2005 Wu
7,192,301 B2 * 3/2007 Kuroda et al. ..... 439/497

* cited by examiner

*Primary Examiner*—Thanh-Tam T Le
(74) *Attorney, Agent, or Firm*—Wei Te Chung

(57) ABSTRACT

A cable connector assembly (100) in accordance with the present invention includes a printed circuit board (2) having a number of signal and ground pads (25, 26) alternatively arranged at opposite front and rear ends (21, 22) thereof, a conductive wire organizer (3) including a body portion (30) defining a number of through holes (300) and a number of ground plates (31) integrally extending forwardly from the body portion to electrically connecting with the ground pads of the printed circuit board, and a number of wires (4) protruding through the through holes of the wire organizer. Each wire includes at least one signal conductor (40) soldered with the signal pad of the printed circuit board, an insulator (41) enclosing the at least one signal conductor and a conductor layer (42) enclosing the insulator and electrically connecting with the wire organizer.

16 Claims, 7 Drawing Sheets

CABLE CONNECTOR ASSEMBLY WITH IMPROVED WIRE ORGANIZER

BACKGROUND OF THE INVENTION

1. Field of the Invention

The present invention generally relates to a cable connector assembly, and more particularly to a cable connector assembly for high-speed signal transmission.

2. Description of Related Art

For high-speed signal transmission electrical connectors, EMI and wire management are two most significant problems to be solved since such electrical connector usually has a large number of wires to transmit signals which need to be managed. Infiniband connector is a kind of high-speed signal transmission connector which comprises an insulative housing, a plurality of signal and ground terminals retained in the insulative housing, a spacer assembled to the housing and the terminals, a plurality of wires each comprising a signal differential pair transmitting positive and negative signals and a grounding conductor. The wires are managed by the spacer with the signal differential pairs and the grounding conductors respectively electrically connecting with the signal and ground terminals. Additionally, for depressing EMI, a grounding plate is adopted to electrically connect with the ground terminals and the grounding conductors.

Such features are disclosed in U.S. Pat. Nos. 6,685,501, 6,726,503, 6,764,342, 6,869,308, and 6,739,904. As for U.S. Pat. Nos. 6,685,501, 6,869,308 and 6,739,904, each spacer disclosed therein is a whole piece or a pair of upper and lower halves defines a plurality of aligning holes to permit the penetration of wires for aligning the wires. Each spacer is assembled with a large number of ground plates each soldered to corresponding grounding conductors of the wires and ground terminal to depress EMI in signal transmission. However, the number of the ground plates is large which is costly and assembling the so many ground plates to the spacer is time consuming and also costly.

U.S. Pat. No. 6,726,503 discloses an Infiniband type connector with a spacer having upper and lower halves assembled together to align wires and engaging with tail portions of ground terminals with grounding conductors electrically connecting with the tail portions of the ground terminals. U.S. Pat. No. 6,764,342 discloses a whole-piece spacer aligning wires and assembled with a pair of ground plates and short arms of ground terminals with the ground plates directly electrically connecting with grounding conductors of the wires and the short arms of the ground terminals to form electrical connection between the ground terminals and the grounding conductors of the wires. However, the ground terminals of these two connectors all directly connect the ground plates or the grounding conductors of the wires. In some circumstances, a printed circuit board is needed to realize the electrical connection between terminals and wires. The spacers and the ground plates are not suitable for above circumstance. Therefore, a cable connector with improved wire organizer and ground plate is desired to be developed to address above problems.

BRIEF SUMMARY OF THE INVENTION

Accordingly, an object of the present invention is to provide a cable connector assembly with improved wire organizer to achieve wire alignment and EMI depression.

In order to achieve the above-mentioned object, a cable connector assembly in accordance with the present invention comprises a printed circuit board having a plurality of signal and ground pads alternatively arranged at opposite front and rear ends thereof, a conductive wire organizer comprising a body portion defining a plurality of through holes and a plurality of ground plates integrally extending forwardly from the body portion to electrically connecting with the ground pads of the printed circuit board, and a plurality of wires protruding through the through holes of the wire organizer. Each wire comprises at least one signal conductor soldered with the signal pad of the printed circuit board, an insulator enclosing the at least one signal conductor and a conductor layer enclosing the insulator and electrically connecting with the wire organizer.

Other objects, advantages and novel features of the invention will become more apparent from the following detailed description of the present embodiment when taken in conjunction with the accompanying drawings.

DETAILED DESCRIPTION OF THE INVENTION

Figure 1:
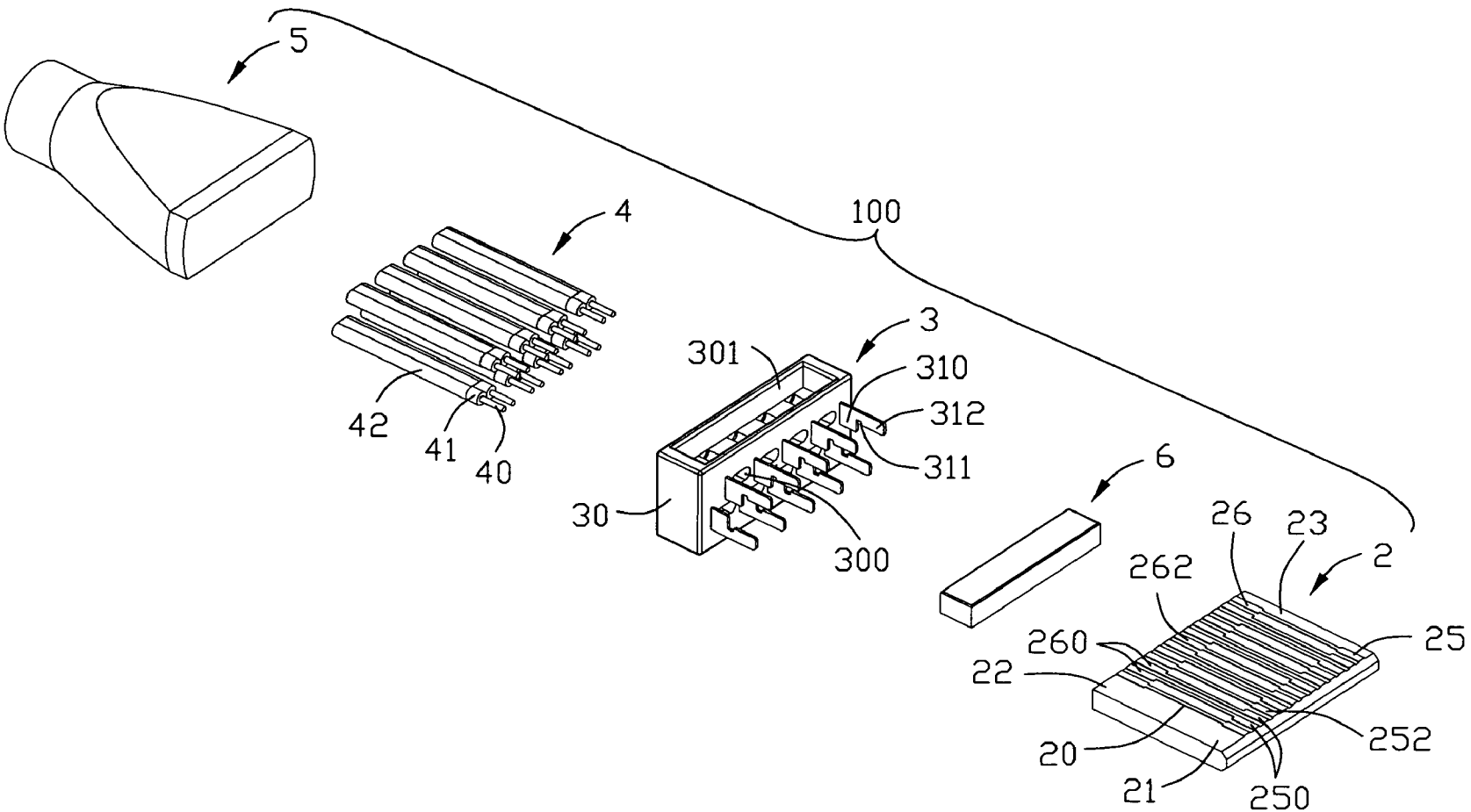
FIG. 1 is an exploded, perspective view of a cable connector assembly in accordance with the preferred embodiment of the present invention.

Reference will now be made to the drawing figures to describe the present invention in detail.

Figure 2:
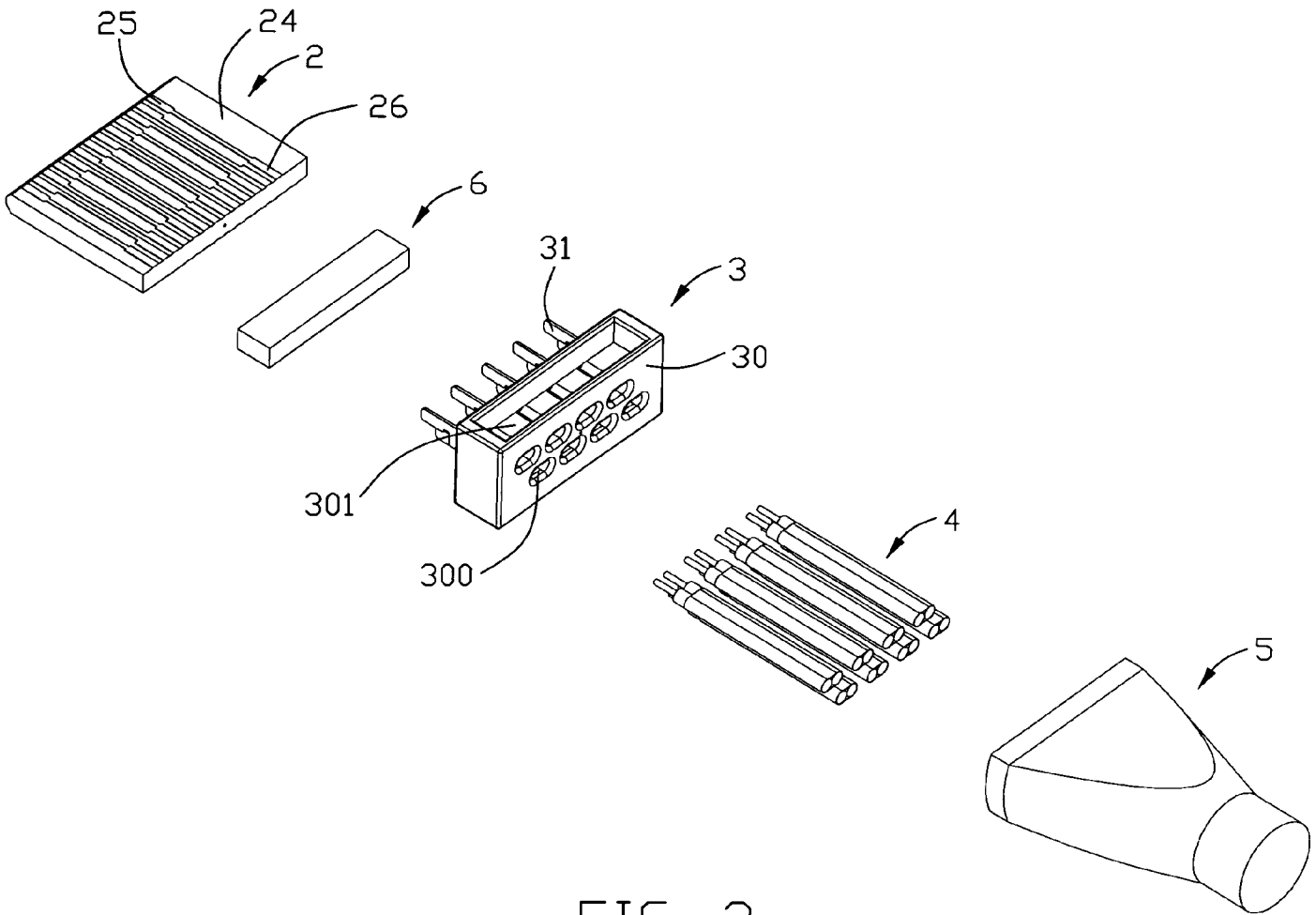
FIG. 2 is a view similar to FIG. 1, but viewed from a different aspect.
Figure 3:
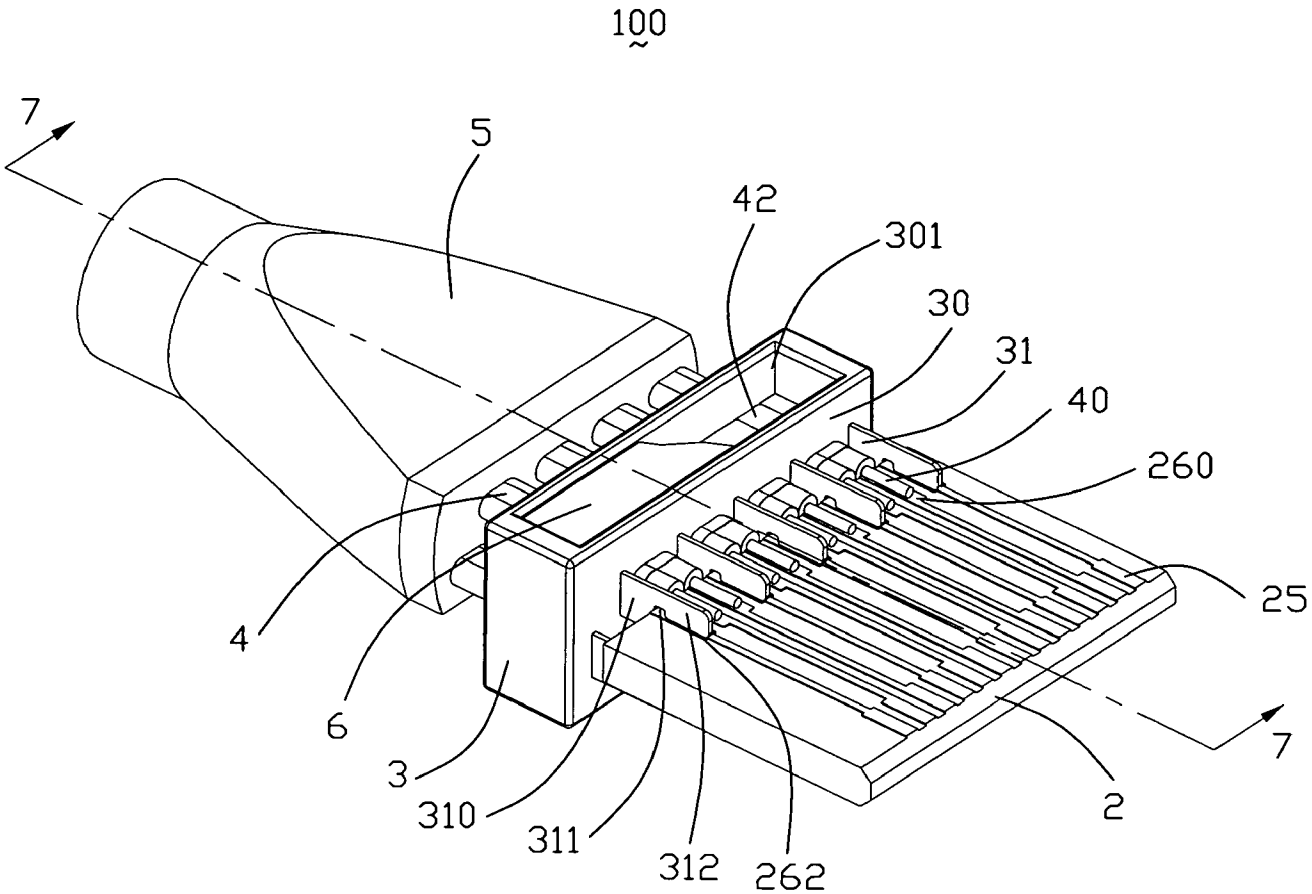
FIG. 3 is an assembled view of FIG. 1.
Figure 4:
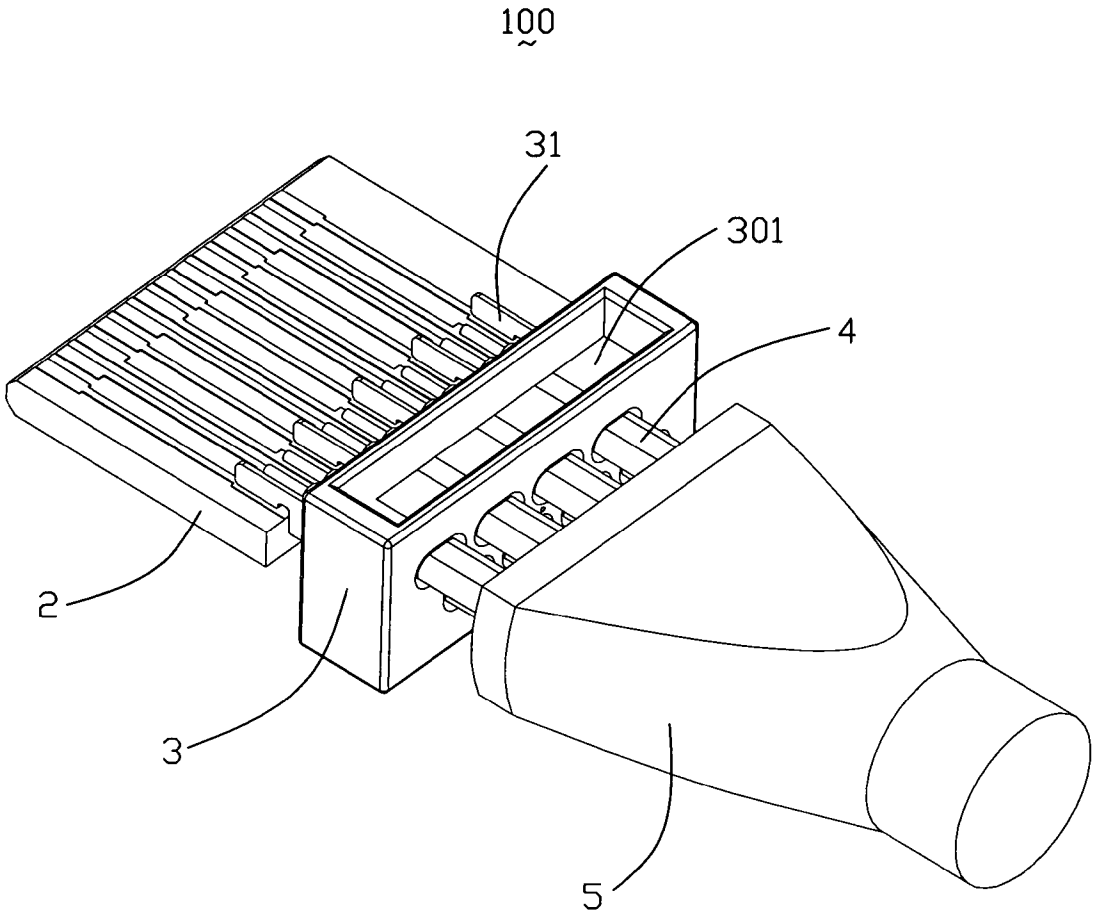
FIG. 4 is a view similar to FIG. 3, but viewed from a different aspect.
Figure 5:
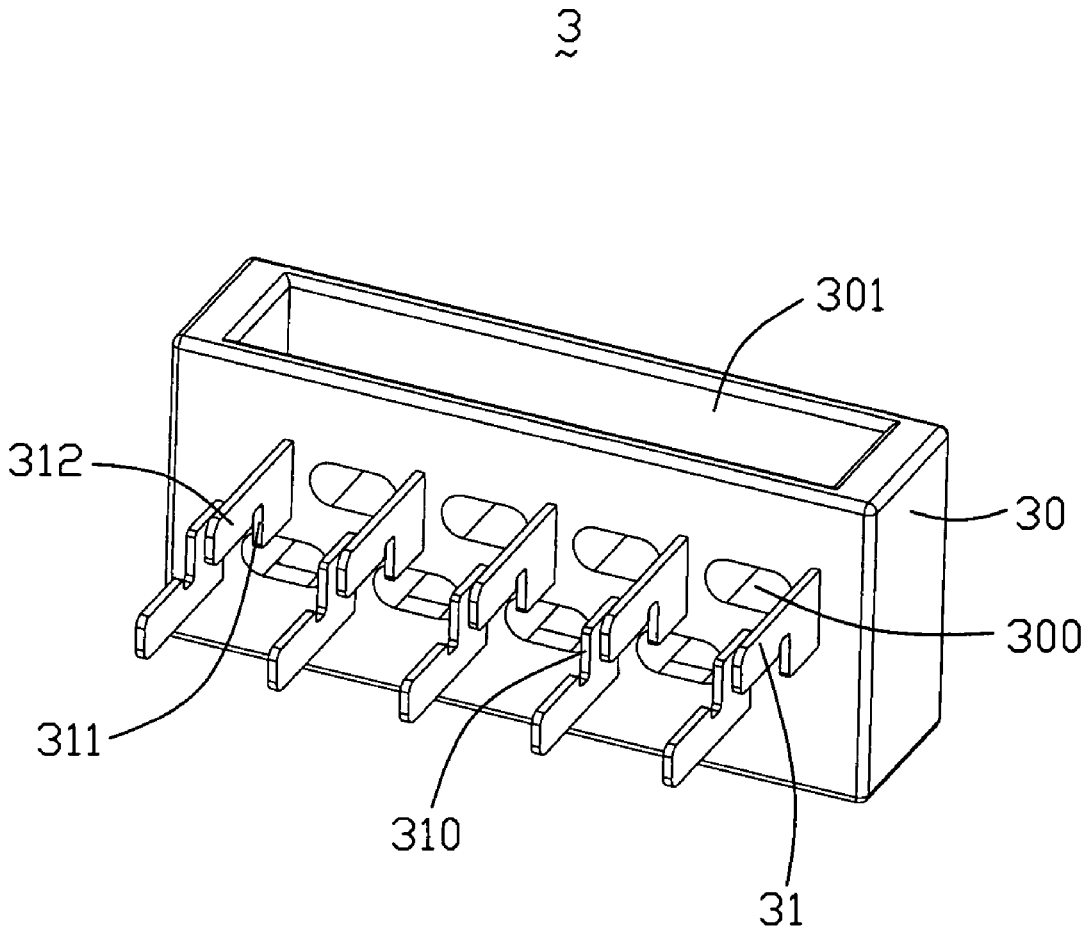
FIG. 5 is an enlarged view of a wire organizer of the cable connector assembly.
Figure 6:
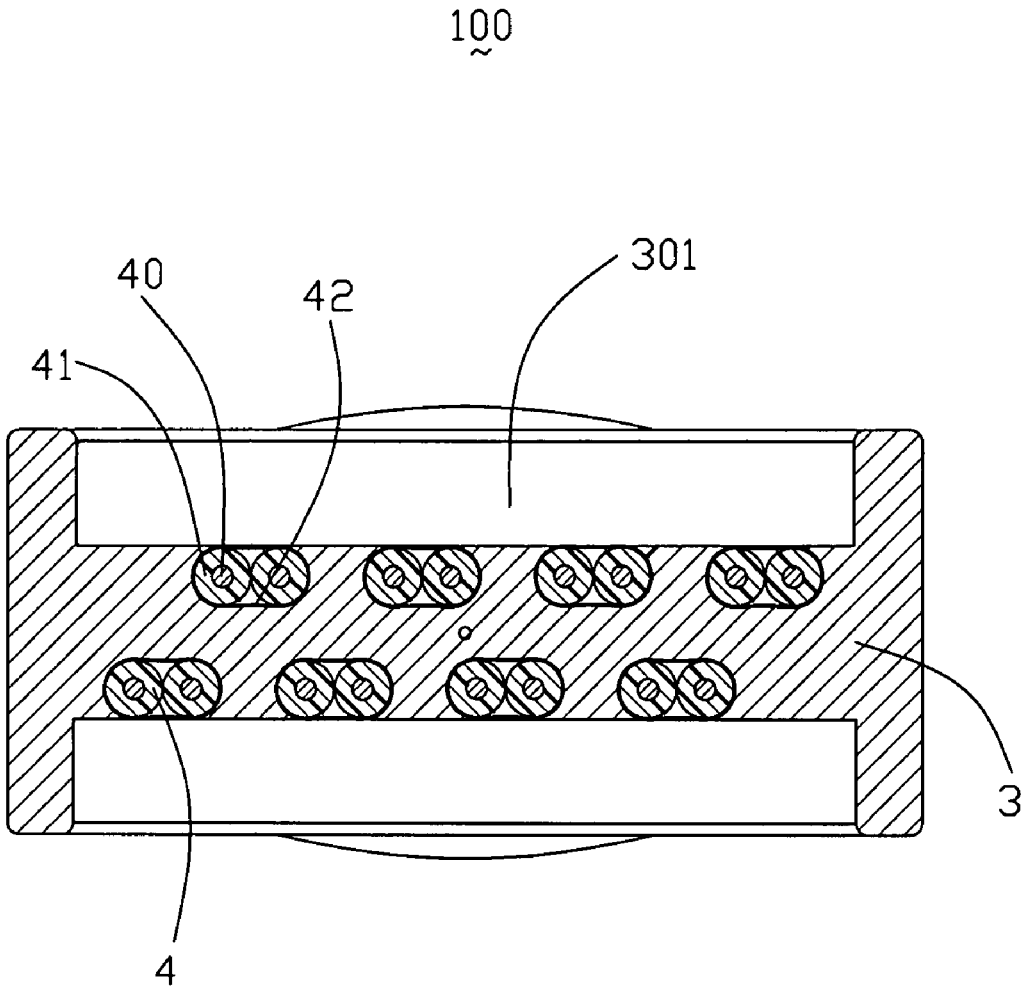
FIGS. 6-7 are cross-section views taken along lines 6-6 and 7-7 of FIG. 3.
Figure 7:
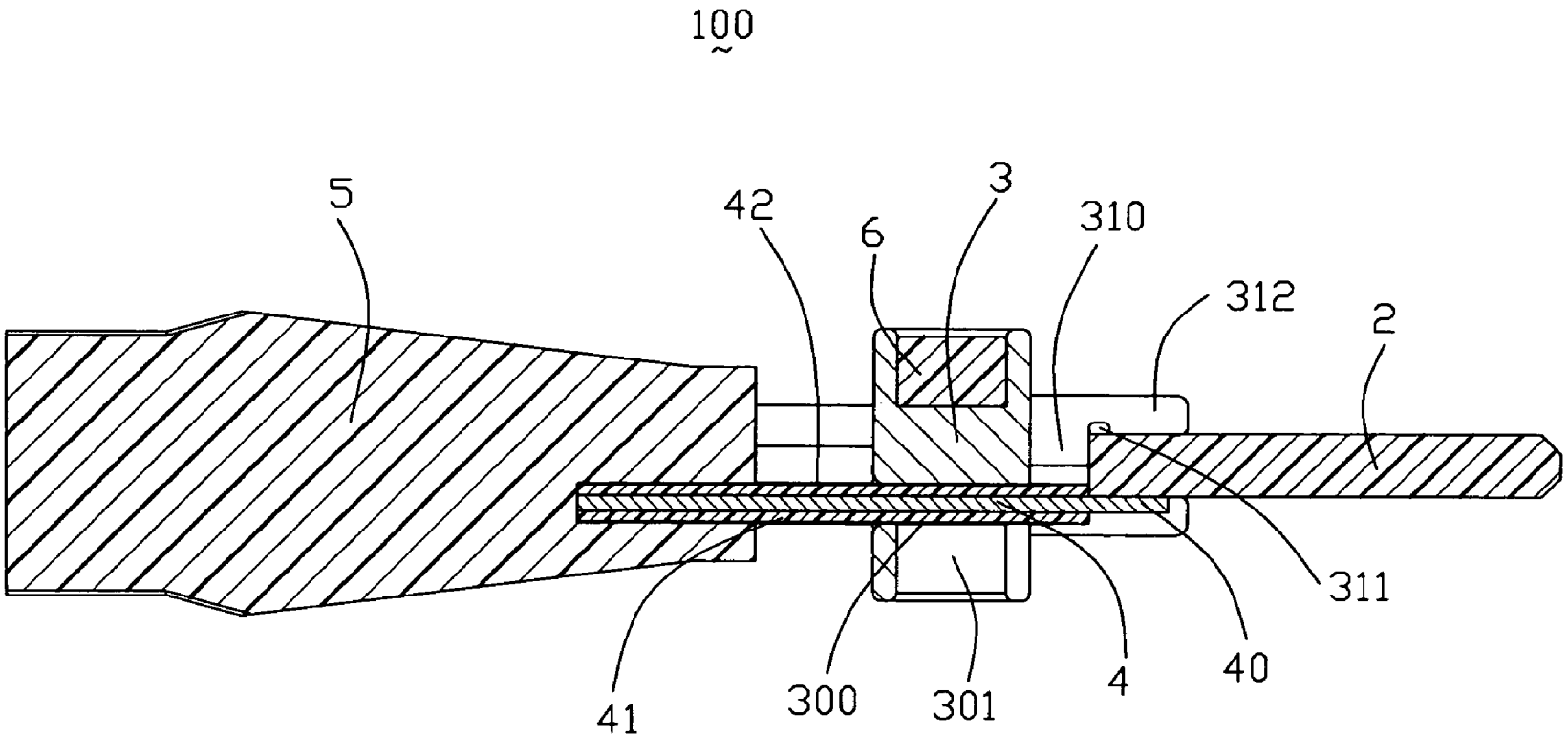

Please refer to FIGS. 1-2, a cable connector assembly 100 in accordance with the preferred embodiment of the present invention comprises a printed circuit board (PCB) 2, a wire organizer 3 electrically connecting with wires 4 and the PCB 2, the wires 4 electrically connecting with the wire organizer 3 and the PCB 2 at the same time, an inner mold 5 molded with the wires 4, and a die-cast casing (not shown) enclosing all the members mentioned above therein with the wires 4 exiting from rear end of the casing and the mating interface accessible from front end of the casing.

The PCB 2 is a flat board and comprises opposite front and rear ends 21, 22 and opposite upper and lower surfaces 23, 24. A plurality of first and second conductive pads 25, 26 are formed at front and rear ends 21, 22 of the upper and lower surfaces 23, 24. The first and second conductive pads 25, 26 are in pairs along front-to-rear direction and each pair 25, 26 connects to each other by a conductive trace 20. Each set of the first and second conductive pads 25, 26 consist of four sets of signal differential pairs 250, 260 and five ground pads 252, 262 alternatively arranged with the signal differential pairs 250, 260 for assuring signal transmission effect.

The wire organizer 3 is made from conductive material and comprises a rectangular body portion 30 and an upper and lower rows of ground plates 31 extending forwardly from front surface of the body portion 30. The body portion 30 defines upper and lower rows of elliptic-shape through holes 300 each located between adjacent two ground plates 31. The inner periphery of each through hole 300 is same as outer periphery of each wire 4. The upper row of the ground plates 31 are not aligned with the lower row of the ground plates 31, that is to say, each ground plate 31 of the upper row is located in a middle of two ground plates 31 of the lower row along vertical direction. Of course, the through holes 300 of the upper row are not aligned with the through holes 300 of the lower row. A pair of openings 301 are respectively recessed downwardly and upwardly from upper and lower surfaces of the body portion 30 and respectively communicate with the through holes 300 of the upper row and the through holes 300 of the lower row. Each ground plate 31 is substantially of L-shape and comprises a rear wider stop portion 310 connecting with the body portion 30 and a narrower soldering portion 312 extending from upper/lower part of the ground plate of upper/lower row. A slit 311 extends upwardly/downwardly from the joint location of the stop portion 310 and the soldering portion 312 for receiving excessive solder when soldering the ground plates 31 with the ground pads 262 of the PCB 2.

The wires 4 are divided into upper and lower groups corresponding to the through holes 300 of the wire organizer 3, that is, each wire 4 of the upper group is located in the middle of the two adjacent wires 4 of the lower group viewed from up-to-down direction. Such arrangement helps to reduce cross talk in signal transmission. Each wire 4 comprises a pair of signal conductors 40 respectively transmitting positive and negative signals, a pair of insulators 41 respectively enclosing corresponding signal conductors 40, and a conductive layer 42 enclosing the pair of insulators 41 to serve as ground conductor. The front end of the wire 4 is partially stripped to expose the pair of signal conductors 40, the front ends of the pair of insulators 41 along front-to-back direction.

When assembly, the inner mold 5 is firstly molded with the wires 4 to hold the wires 4 together. Then, the wires 4 respectively protrude through the through holes 300 of the wire organizer 3 to fill up the through holes 300 until the front ends of the signal conductors 40 substantially extends to the front edges of the ground plates 31. Thus, front end of each wire 4 exposed beyond the front surface of the wire organizer 3 is located between adjacent ground plates 31. The conductive layers 42 of the wires 4 contact inner peripheries of the through holes 300 to form electrical connection between the wires 4 and the wire organizer 3, and the middle portions of the wires 4 received in the wire organizer 3 are exposed in the openings 301 of the wire organizer 3. A pair of rectangular blocks 6 (for simple illustration, only one rectangular block 6 is shown) which are conductive blocks are pressed into the openings 301 and soldered with the body portion 30 of the wire organizer 3 to press the exposed portions of the wires 4 for adjusting the configurations of the wires 4 to fit in the through holes 300 well. The pair of rectangular blocks 6 also can be glue made from Epoxy Bong spread into the openings 301 fill the openings 301 and position the wires 4 relative to the wire organizer 3. Then, the wires 4 and the wire organizer 3 are assembled to the PCB 2 together with the stop portions 310 abut against the rear end 22 of the PCB 2. The soldering portions 312 of the ground plates 31 and the signal conductors 40 are respectively soldered to the ground pads 262 and the signal differential pairs 260 of the second conductive pads 26 to form electrical connection therebetween. Thus, signal transmission paths and grounding paths are established. The conductive wire organizer 3 has dual-functions, one is aligning and positioning the wires 4, the other is establishing grounding paths to depress EMI in signal transmission. When mating with a complementary connector, the first conductive pads 25 of the PCB 2 may directly electrically connect with terminals of the complementary connector, or soldered with contacts (not shown) assembled into an insulative housing (not shown) of the cable connector assembly of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly adapted for high-speed signal transmission, comprising:

a printed circuit board having a plurality of signal and ground pads alternatively arranged at opposite front and rear ends thereof;

a conductive wire organizer comprising a body portion defining a plurality of through holes and a plurality of ground plates integrally extending forwardly from the body portion to electrically connecting with the ground pads of the printed circuit board;

a plurality of wires protruding through the through holes of the wire organizer, each wire comprising at least one signal conductor soldered with the signal pad of the printed circuit board, an insulator enclosing the at least one signal conductor and a conductive layer enclosing the insulator and electrically connecting with the wire organizer;

wherein the ground plates and the wires are respectively arranged into upper and lower rows, and wherein the signal and ground pads of the printed circuit board are arranged on upper and lower surfaces of the printed circuit board to electrically connect with the signal conductors and the ground plates;

wherein each ground plate of the upper row respectively locate between a pair of ground plates of the lower row viewed from up-to-down direction, and each wire of the upper row locates between a pair of wires of the lower row viewed from up-to-down direction.

2. The cable connector assembly as claimed in claim 1, wherein the at least one signal conductor of each wire locates between adjacent two ground plates of the wire organizer.

3. The cable connector assembly as claimed in claim 1, wherein each wire comprises a pair of signal conductors respectively transmitting positive and negative signals, and wherein the signal pads of the printed circuit board form a plurality of signal differential pairs alternatively arranged with the ground pads to electrically connect with the signal conductors.

4. The cable connector assembly as claimed in claim 1, wherein each ground plate locates in a vertical plane and is of L-shape, the ground plate comprises a stop portion connecting with the wire organizer and abutting against rear end of the printed circuit board and a soldering portion extending forwardly from the stop portion to be soldered with the ground pad of the printed circuit board.

5. The cable connector assembly as claimed in claim 1, wherein the body portion of the wire organizer defines an opening communicating with at least one of upper and lower surfaces of the body portion and communicating with the through holes with the wires partially exposed in the opening.

6. The cable connector assembly as claimed in claim 5, further comprising a conductive block filled into the opening and pressing the wires exposed in the opening.

7. The cable connector assembly as claimed in claim 6, wherein the conductive block is soldered with the wire organizer.

8. The cable connector assembly as claimed in claim 5, wherein glue is spread into the opening to form a block filling up the opening to position the wires relative to the wire organizer.

9. A cable connector assembly adapted for high-speed transmission, comprising:

a plurality of signal contacts consisting signal differential pairs transmitting positive and negative signals;

a plurality of ground contacts alternatively arranged with the signal differential pairs;

a conductive wire organizer defining a plurality of through holes and a plurality of ground plates extending forwardly therefrom and alternatively arranged with the through holes;

a plurality of wires, each wire comprising a pair of signal conductors and a conductive layer enclosing the signal conductors and isolating from the signal conductors; and wherein the wires protrude through corresponding through holes of the wire organizer with the conductive layers thereof electrically connecting with the wire organizer and the front ends of the signal conductors exposed beyond front surface of the wire organizer to each locate between adjacent two ground plates, and the exposed signal conductors and the ground plates respectively soldered with the signal differential pairs and the ground contacts; and wherein the ground plates, the through holes and the wires are arranged into upper and lower rows, and wherein each of the ground plates, the through holes and the wires of the upper row is offset from corresponding one of the lower row along lateral direction.

10. The cable connector assembly as claimed in claim 9, wherein the conductive layer of each wire contacts inner periphery of corresponding through hole.

11. The cable connector assembly as claimed in claim 9, wherein each ground plate located in a vertical plane with a certain width along up-to-down direction to shield corresponding signal differential pair of the wire.

12. A cable connector assembly comprising:

a printed circuit board defining a plurality of conductive grounding and signal pads on a rear region;

a conductive wire organizer having a body defining a plurality of through grooves therein and a plurality of grounding plates conductively extending therefrom and mechanically and electrically connected to the corresponding grounding pad;

a plurality of wires extending through the corresponding through grooves, respectively, each of said wires including an inner conductor and an outer conductor separated by an insulative layer;

at least one block received in the body to press the wires for holding the wires in position within the organizer;

wherein for each of said wires, the inner conductor is mechanically and electrically engaged with corresponding signal pads, and the outer conductor is mechanically and electrically engaged with the body; and wherein the grounding plates, the through grooves and the wires are arranged into upper and lower rows, and wherein each of the grounding plates, the through grooves and the wires of the upper row is offset from corresponding one of the lower row along lateral direction.

13. The cable connector assembly as claimed in claim 12, wherein the outer conductor is engaged within an inner peripheral of the corresponding through groove for conduction.

14. The cable connector assembly as claimed in claim 12, wherein said block is conductive.

15. The cable connector assembly as claimed in claim 12, wherein each of said through grooves is essentially located between the two corresponding neighboring grounding plates.

16. The cable connector assembly as claimed in claim 12, wherein said through groove is essentially a through hole having a complete circumference at either end.

* * * * *